United States Patent [19]

Evans

[11] 4,240,586

[45] Dec. 23, 1980

[54] METHOD AND APPARATUS FOR CRUSHING AND CLASSIFYING PARTICULATE MATERIAL

[76] Inventor: Robert F. Evans, 631 Honeywood La., La Habra, Calif. 90631

[21] Appl. No.: 971,808

[22] Filed: Dec. 21, 1978

[51] Int. Cl.[3] ..... B02C 13/14; B02C 15/08

[52] U.S. Cl. ..... 241/19; 241/79; 241/103; 241/109

[58] Field of Search ..... 241/46 R, 46.15, 79, 241/79.1, 103, 106, 107, 109, 110, 114, 117, 18, 19, 24

[56] References Cited

U.S. PATENT DOCUMENTS

| | | | |
|---|---|---|---|
| 336,030 | 2/1886 | Wiswell | 241/46.15 |
| 519,228 | 5/1894 | Bishop | 241/109 |
| 561,538 | 6/1896 | Carbart | 241/109 |
| 822,913 | 6/1906 | Boss | 241/46.15 |
| 3,510,071 | 5/1970 | Whitney, Jr. | 241/103 X |
| 3,951,347 | 4/1976 | Tiggesbaumker et al. | 241/79.1 |

FOREIGN PATENT DOCUMENTS

| | | | |
|---|---|---|---|
| 154112 | of 1902 | Fed. Rep. of Germany | 241/46 |
| 872 | of 1853 | United Kingdom | 241/114 |

*Primary Examiner*—Richard B. Lazarus
*Attorney, Agent, or Firm*—John R. Ley

[57] ABSTRACT

Friable particulate material is crushed and classified by apparatus comprising a grinder apparatus operatively positioned in the hollow interior of a relative rotationally mounted container. The grinder apparatus preferably comprises three rotationally mounted cone wheel roller members, each of which includes an outer grinding surface of predetermined contour. The outer grinding surface of each of the roller members maintains substantial conformance with a grinding face of the cylinder container from a center area to an outer edge of the grinding face as the roller members rotate. Feed particles of friable material and a continuous supply of fluid are introduced into the container and diffused substantially over the whole grinding face. Once the feed particles have been crushed to a predetermined size, the crushed particles are carried away from the grinding face by the flow of fluid exiting the hollow interior. The fluid velocity is controlled to remove a predetermined range of size of crushed particles from the grinding face and to separate or classify the removed crushed particles according to size and weight.

58 Claims, 8 Drawing Figures

METHOD AND APPARATUS FOR CRUSHING AND CLASSIFYING PARTICULATE MATERIAL

BACKGROUND OF THE INVENTION

1. Field of the Invention

This invention relates to crushing and grinding friable material and to classifying the crushed material into ranges of particle size. More specifically, the present invention involves method and apparatus by which particles of friable material are efficiently crushed by grinder apparatus maintaining substantial conformance with a grinding face, and by which fluid flow velocities are controlled to determine the extent of crushing which takes plce and to calssify the crushed particles according to weight or size.

2. Brief Description of Prior Art

Numerous arrangements for crushing, mixing, kneading or otherwise acting on various types of materials, including friable materials, are known in the art. Such arrangements have proved useful in various applications, including ore processing and paint, food and drug manufacturing. However, such prior art arrangements possess certain recognized disadvantages, and these disadvantages have persisted and not been materially minimized or eliminated prior to the present invention.

One prior art disadvantage relates to efficiency. In many prior art devices an excessive amount of input energy is expended in the needless moving about of the material to be ground without actually grinding that material. Also some prior art designs needlessly overgrind the material. Among other things, reduced efficiency results in increased requirements for input energy to obtain given quantities of useable work product.

Another significant disadvantage of prior art arrangements is the inability to effectively control the amount of grinding or crushing which takes place. Although some prior art arrangements have been suggested, these arrangements generally lack the precise control to effectively remove the crushed particles from the grinding surfaces once the crushed particles have been reduced to a size or weight within a predetermined and desired range.

A further disadvantage of many prior art material processing systems involving grinding or crushing is that the crushed material must be separated or classified separately in a distinct operation from the grinding operation. Consequently separate machinery for this purpose must be provided, and its operation requires further energy consumption and supervision. Furthermore by ineffectively controlling the amount of grinding which occurs in the grinding apparatus, the material supplied for separate classification may be overground or not sufficiently crushed to the desired range of weights or sizes. In such circumstances, the material which has been crushed too finely may be unusable, or the material which has not been sufficiently crushed must be returned to the grinder apparatus.

Other disadvantages and limitations of prior art are known. Those skilled in the art may recognize other limitations and disadvantages, in view of the desirable aspects of the present invention, but comprehension of the desirable aspects of this invention should not diminish the significance of many of the previous troublesome limitations of the prior art.

SUMMARY OF THE INVENTION

It is the general objective of the invention to provide a new and improved apparatus, system and method for crushing friable material into crushed particles, which overcomes many of the disadvantages of the prior art, and which provides significant advantages over the prior art. More specific objectives include substantially increasing the effectiveness and efficiency of crushing friable materials, avoiding unnecessary loss of efficiency by effectively contacting and crushing the particles, and avoiding the unnecessary crushing of the particles more or less than a desired predetermined amount. Another specific objective is to provide a new and improved grinding apparatus of a nature which more effectively crushes the material, which is economical to manufacture and use, and which can be readily and conveniently made available for grinding use. Another significant objective is to make available an approach to both grinding friable material and classifying the crushed particles according to different sizes and weights in a single operation. Finally, one more of many other significant objectives is to teach a method of classifying particulate matter of a variety of sizes or weights into various size and weight categories.

One broad aspect of the invention relates to a grinder apparatus having a plurality of roller wheels positioned within the hollow interior of a container. The container defines a grinding face which may include a substantial portion of an end wall of the container and a portion of a side wall of the container adjoining the end wall. Each roller wheel member includes a grinding surface of predetermined contour for matching and confronting the grinding face of the container as the container rotates relative to the grinder apparatus. The preferred grinder apparatus includes three cone wheel members positioned to extend from near the relative rotational axis outward to the side wall of the container. The arrangement provides increased grinding efficiency and effectiveness and is readily and inexpensively manufactured and used.

Another broad aspect of the invention relates to controlling the extent of particle crushing in the container by controlling a fluid velocity flow at the grinding face at which the particles are crushed. The size or weight of the crushed particles which will be picked up and carried in the fluid flow is proportional to fluid velocity and fluid density. By controlling fluid velocity at the grinding face, the extent of particle crushing is controlled. The crushed particles are immediately removed once they have been crushed to a desired size or weight, thereby avoiding overgrinding or overcrushing, and the particles which have not been crushed to a sufficiently reduced size remain at the grinding face for further crushing.

A further broad aspect of the invention relates to classifying or separating the crushed particles. The crushed particles are carried by and transported within a fluid flow. The fluid velocity rate is controlled or varied in a predetermined manner. The crushed particles congregate or hover at postions where the fluid velocity drag effect on the particle is equal to the gravity weight effect. The hovering particles are classified by the variations in velocity of fluid flow, and these classified particles are thereafter removed from the fluid.

Other significant aspects, objectives, advantages and improvements appear in the following claims, description of the preferred embodiments, and from the drawings described below.

DESCRIPTION OF PREFERRED EMBODIMENTS

Figure 1:
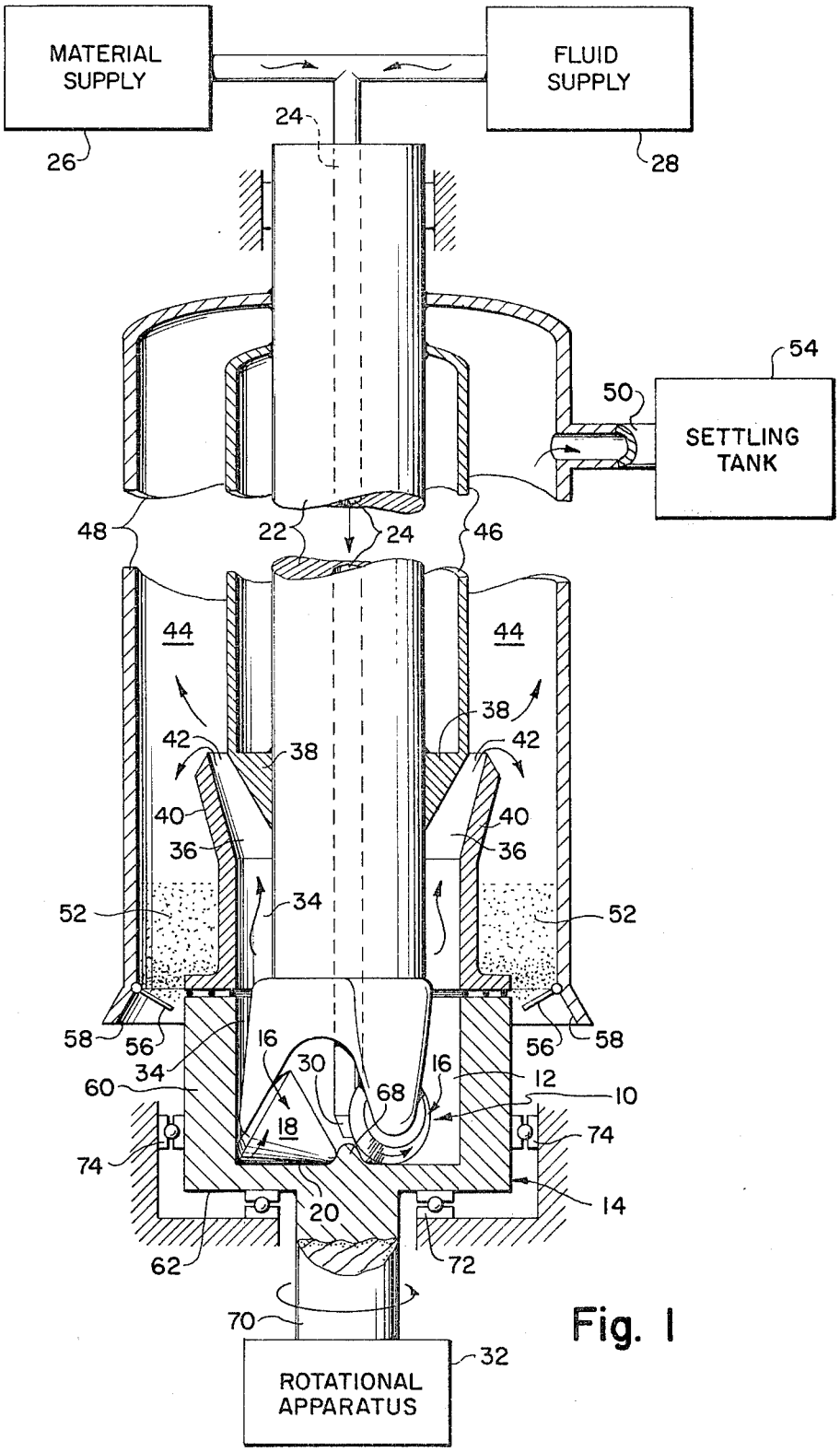
FIG. 1 is a generalized view of apparatus of the present invention showing a grinding apparatus and a stem member in vertical elevation, a container and one particle classification means in vertical section, and other elements, some of which are represented in block diagram form.

The method and apparatus of the present invention is generally introduced by reference to FIG. 1. The apparatus for crushing friable material into particulate form basically comprises a grinder apparatus 10 positioned within a hollow interior 12 of a container 14. The grinder apparatus 10 includes a plurality of cone wheels or roller members 16, each of which includes an outer grinding surface 18 of predetermined contour. A stationary stem member 22 is connected to grinder apparatus 10 and positions the grinding surface 18 of each cone wheel 16 in a closely confronting or contacting relation with a grinding surface 20 defined by the container 14. A conduit 24 is formed in the stem member 22 and introduces or conducts feed particles of friable material to be crushed and a supply of fluid into the hollow interior 12. Feed particles and fluid are respectively supplied to the conduit 24 from a friable material supply 26 and fluid supply 28. A nozzle 30 introduces the feed particles and fluid into the hollow interior adjacent the grinding face 20.

Crushing or grinding of the feed particles occurs during relative rotation of the grinder apparatus 10 and the container 14. Relative rotation is effected by conventional rotating apparatus 32 operatively connected to rotate the container 14 relative to the stationarily positioned grinder apparatus 10. The feed particles are crushed into smaller particles between the confronting grinding surfaces 18 and the grinding face 20 as the cone wheel members 16 traverse or roll over the rotating grinding face 20 of the container. Once the feed particles have been crushed or reduced to a sufficiently small size and weight, the flow velocity and density of the fluid becomes effective to transport the crushed particles away from the grinding face 20 out of the container. Larger feed particles which have not been sufficiently crushed remain at the grinding face until they are crushed to the desired size and weight.

The velocity of volumetric flow at which the fluid flows over the grinding face 20 and the specific gravity or density of the fluid control the size and weight of crushed particles which are transported away from the grinding face. Once the fluid drag force on the crushed particles created by the volumetric fluid flow exceeds the weight of the crushed particles, the crushed particles move with and are carried within the fluid flow. The weight of particles carried by the fluid flow is directly proportional to the velocity of fluid flow. The density or specific gravity of the fluid also controls the weight of particle carried by the fluid flow, since a higher density fluid produces a greater buoyancy on the particles. The velocity flow of fluid of predetermined density is controlled to remove only those crushed particles in a desired range of sizes and weights. With approximately uniform density material, the size of a particle is directly related to weight. Consequently, size and weight are approximately synonymous in describing the type of particles removed by controlling the velocity of fluid flow.

The fluid and transported particles flow upward out of the hollow interior 12 through an outlet defined by an annulus area 34 and an annular passageway 36. The annular passageway 36 is defined by an inner baffle cone member 38 and a concentrically positioned outer baffle tube member 40. An annular opening 42 is formed by the upper ends of the baffle members 38 and 40, and the opening 42 discharges the fluid and transported particles into a separation chamber 44.

The separation chamber 44 is defined by an inner tubular member 46 and an outer tubular member 48. An outlet 50 is defined in the outer housing 48 at a position upwardly spaced from the opening 42. The cross-sectional area of the chamber 44 immediately above the opening 42 is considerably larger than the cross-sectional area of the opening 42, and a decrease in flow velocity occurs as the fluid and crushed particles enter the chamber 44 at the opening 42. Flow velocity decreases because the cross-sectional area increases and the volumetric supply rate remains constant. The reduced fluid flow velocity no longer supports the larger crushed particles whose weight is greater than the upward force created by the upward moving fluid between the opening 42 and the outlet 50. Particles larger than a predetermined size settle by gravity to the bottom area 52 of the separation chamber, and the predetermined size and smaller particles continue upward in the reduced velocity of fluid flow out of the outlet 50 and into a settling tank 54. The particles of the predetermined size and smaller settle to the bottom of the settling tank 54 and are thereafter removed. The fluid from the top of the settling tank can be conditioned and returned to the fluid supply 28 for reuse.

The crushed particles of larger than desired size are periodically removed from the lower area 52 of the separation chamber 44 by opening a valve 56. The valve 56 opens and closes a second outlet 58 defined intermediate the outer housing 48 and the baffle tube 38. The material removed from the area 52 of the separation chamber can be resupplied to the material supply 26 for regrinding, or can be separately utilized.

Figure 2:
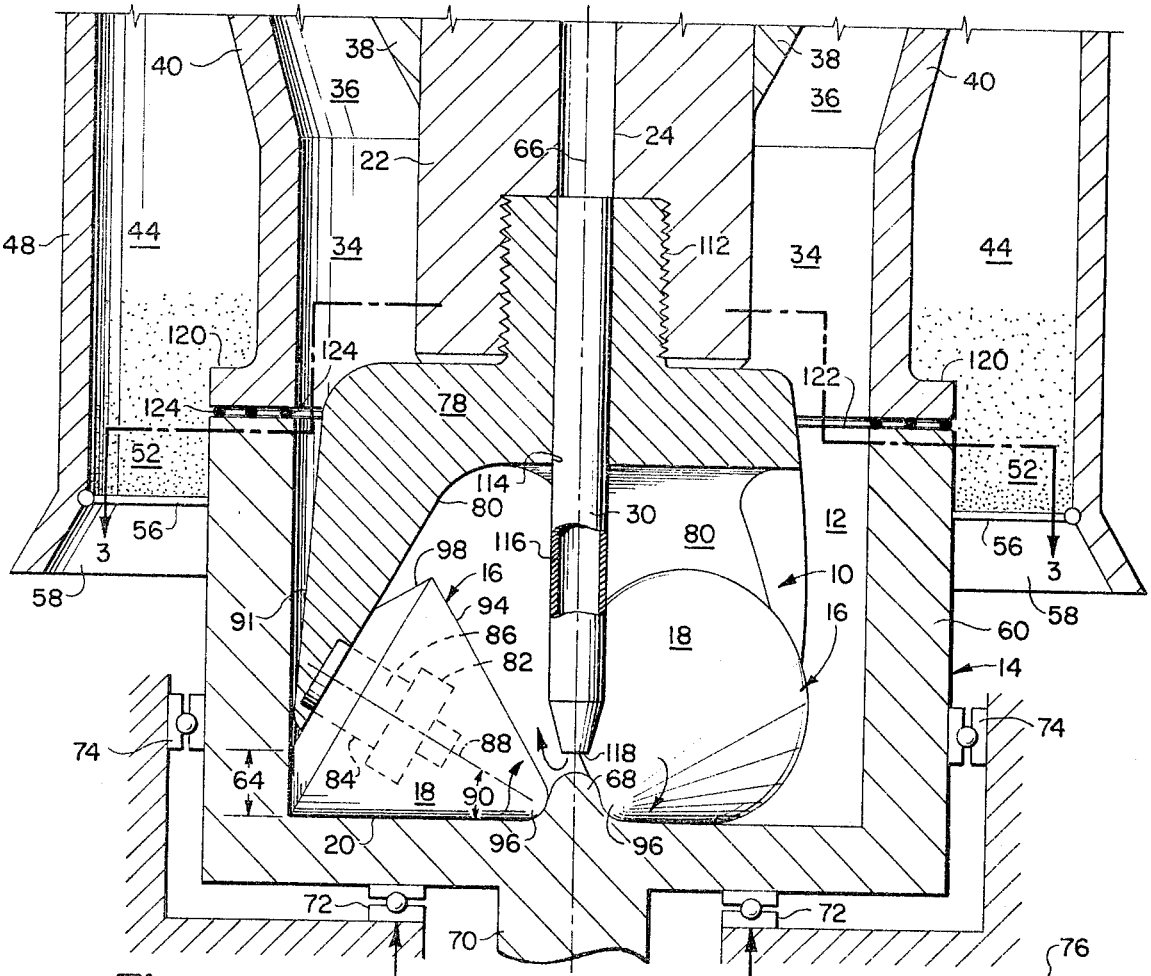
FIG. 2 is an enlarged view of a portion of FIG. 1 illustrating details of the grinder apparatus (part of which is broken away), the container, particle classification means, and other elements, one of which is shown in block diagram form only in FIG. 2.

Details of the grinder apparatus 10 and container 14 are better understood by reference to FIGS. 1 and 2. The hollow interior 12 of the container 14 is closed and fluid-tight and is formed by a continuous side wall 60 and a continuous end wall 62. The end wall 62 extends transversely inward from the side wall 60, and the end wall 62 defines the major portion of the grinding face 20. A lower portion 64 of the side wall adjacent the end wall defines the remaining part of the grinding face 20. The lower portion 64 is concentric with respect to an axis 66 of relative rotation of the container and grinder apparatus. Preferably, the lower portion 64 is cylindrical, as is the remaining portion of the side wall 60.

Figure 4:
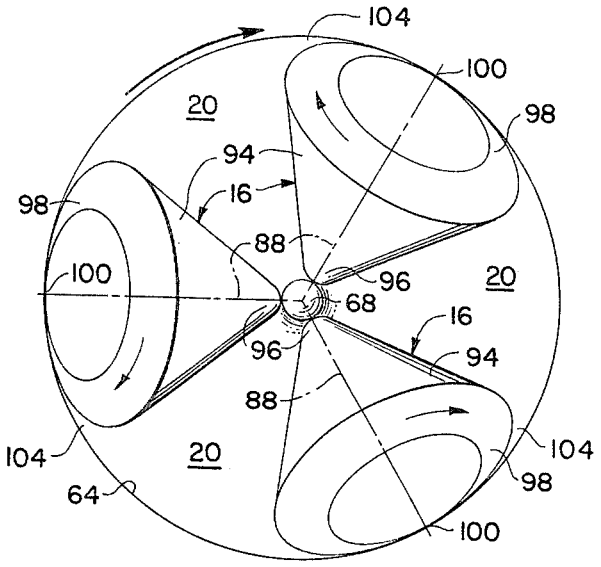
FIG. 4 is a schematic view taken from the same viewing perspective as FIG. 3 and illustrating schematically three cone wheel roller members of the grinder apparatus in confronting relation with a grinding face of the container.

The end wall 62 also includes a radially inward converging and axially projecting diffusing contour 68, also shown in FIG. 4. The diffusing contour 68 is generally concentric about the axis 66, and the contour 68 serves as means for distributing or diffusing the fluid and feed particles supplied from the nozzle 30 radially outward over substantially the whole end wall 62 and grinding face 20.

A shaft 70 is connected from the container to the rotational apparatus 30 and is one means by which the container is rotated. A thrust bearing 72 and a radial bearing 74 rotationally support the container. Axial thrust force supplied from conventional thrust apparatus 76 forces the grinding face 20 into confronting relation with the grinding surfaces 18 of the cone wheels during operation. The radial bearings 74 support the container in an essentially stationary axial position during relative rotation.

The grinder apparatus 10 by itself possesses similarity to a conventional three cone rock bit used for drilling bore holes through earth material, except that the grinding surface 18 of each cone wheel 16 and the provision of the nozzle 30 are substantially different than conventional rock bits. The grinder apparatus 10 includes a support body 78 having a plurality of legs 80 depending therefrom, as shown primarily in FIGS. 2 and 3. Each cone wheel 16 is rotationally and cantileverly connected to a leg 80 by a cone bearing 82 which is received between an interior opening 84 of the cone wheel and a journal member 86 formed on the leg 80. An axis 88 of the journal 86 extends at an intersecting angle 90 with respect to a reference perpendicular to the relative rotational axis 66. The angle 90 is known as a journal angle. The axis of cone wheel rotation is substantially coaxial with the journal axis 88. A center axis of the support body 78 is positioned coaxial with the relative rotational axis 66 of the container and grinder apparatus.

Figure 3:
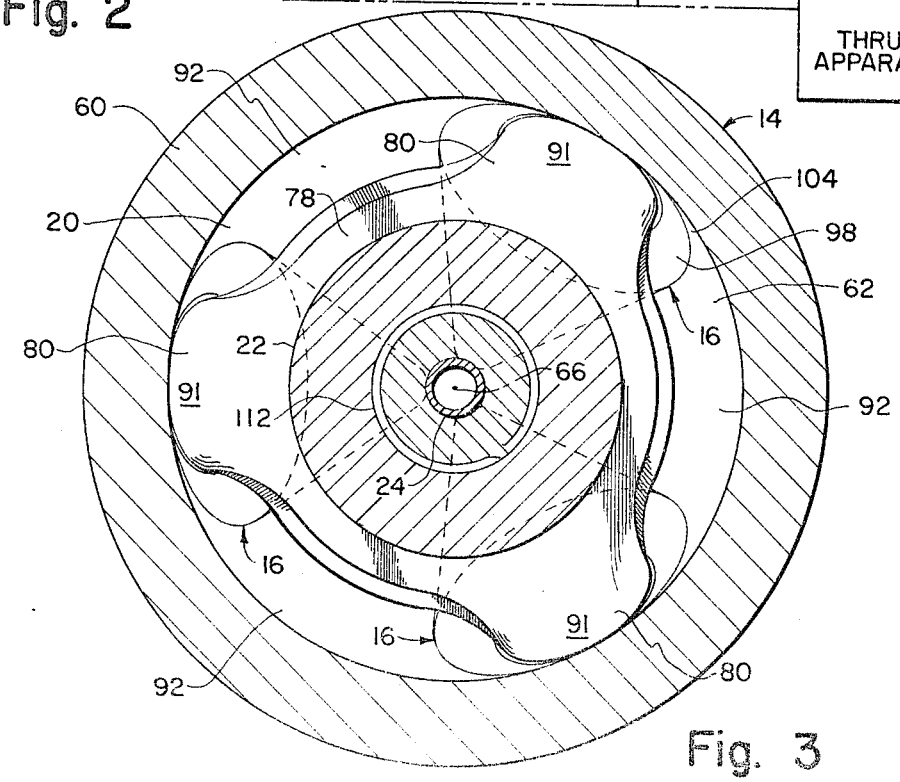
FIG. 3 is a section view taken substantially along the line of 3—3 of FIG. 2.
Figure 5:
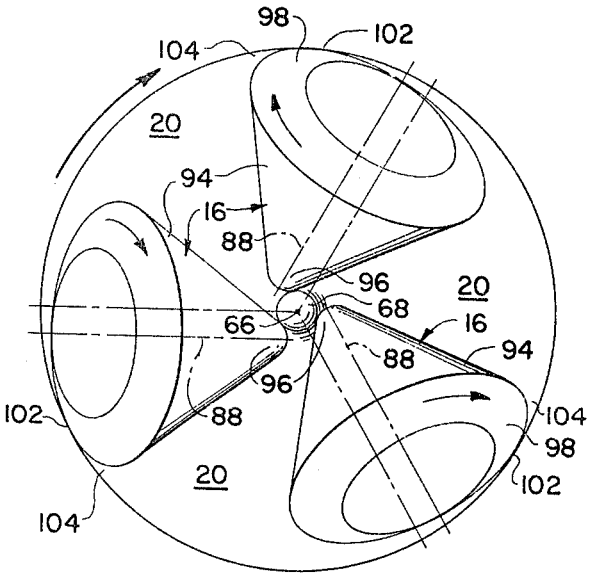
FIG. 5 is a view similar to FIG. 4 illustrating an offset arrangement for positioning the three cone wheel roller members.

As is shown in FIG. 3, the plurality of legs 80 depend from the support body 78 at substantially equal radial distances from the center axis 66. Also, the plurality of legs depend from the support body at substantially equal circumferential intervals with respect to the center axis. In a three cone wheel grinder apparatus, the circumferential interval between adjacent legs is approximately 120 degrees. The outer surface 91 of each leg 80 is positioned a distance radially outward from the axis 66 slightly less than the radius of the cylindrical side wall 60. Thus the outer surface 91 of the legs passes in close next radial adjacency to the side wall 60 during relative rotation. The cone wheel rotational and journal axis 88 each extend radially from the center axis 66 outward, as shown in FIG. 4. An alternative arrangement shown in FIG. 5 positions the cone wheel rotational axis 88 in an offset or spaced parallel manner with respect to a radial reference extending through the center axis 66. The offset configuration is a well-known rock drilling bit configuration. In both the radially-aligned (FIG. 4) and offset (FIG. 5) configurations, the cone wheel rotational axis extends generally outward from the center axis 66 of the support body 78. Positioning the cone wheels in an offset configuration on the grinding apparatus creates a triturating effect on the feed particles as they are crushed. The triturating effect is somewhat similar to that achieved by the well known mortar and pestle. As is shown in FIG. 3, spaces generally referenced 92 exist between adjacent leg members 80 and between the support body 78 and the side wall 62. The fluid and crushed particles flowing away from the grinding face 20 pass upwardly through the areas 92.

The predetermined contour and shape of the grinding face 18 of each of the cone wheel members is best shown in FIG. 2 to include an outer conically shaped portion 94. The axis of the conically shaped portion 94 is the rotational axis 88 of the cone wheel. An arcuate surface 96 generally rounds off the smaller diameter or cross-sectional inner end of the conical surface 94. The arcuate contour of the end surface 96 generally confronts and conforms with the diffusing contour 68 of the end wall 62. A gage surface 98 extends radially inwardly from the point of maximum diameter or circumference of the conical surface 94. The gage surface 98 is concentric about the rotational axis 88 and extends inwardly at a predetermined angle, typically 90 degrees, from the conical surface 94. The gage surface 98 compliments matches and confronts with the lower cylindrical portion 64 of the side wall.

In the configuration shown in FIGS. 1–4, wherein the axis 88 of cone wheel rotation extends along a radial reference from the center axis 66, the gage surface 98 contacts the lower portion of the side wall 64 at points 100 (FIG. 4) in radial alignment with the rotational axis 88 of each cone wheel member. In the offset configuration (FIG. 5), that gage surface 98 contacts the side wall portion 64 at points 102 circumferentially spaced from both the journal axis 88 and the radial reference extending through the center axis 66. These relationships are well known in the rotary drilling art. When the offset configuration is employed in the present invention, the lower portion 64 of the side wall converges slightly inwardly to match the path followed by the gage surface of the offset cone members. However, inwardly converging side wall portion still remains concentric about the center axis 66. The amount and degree of inward convergence of the lower side wall can be readily determined by understanding the well known drilling effects created by offset rotary drill bits.

In both the radially-aligned and offset configurations, a wedged shaped area 104 is defined between the gage surface 98 and the side wall portion 64, rotationally in advance of each cone wheel. The wedged shaped area 104 is slightly smaller with the offset configuration shown in FIG. 5 than in the regular configuration shown in FIG. 4. The wedged shaped area 104 draws feed particles into a crushing relationship between the gage surface 98 and the lower side wall portion 64 of the grinding face, thus increasing the crushing effectiveness of the grinding surfaces 18 against the grinding face 20.

It is apparent from FIGS. 2–5 that the three cone arrangement is compact and occupies a substantial amount of the volume of the lower portion of the hollow interior of the container 14. The compact arrangement assures that the feed particles are rapidly contacted and crushed as they are spread substantially over the whole end wall 62 and grinding face 20 by the diffusing contour 68, as is shown in FIG. 4.

The predetermined contour of the conical surface 94, the arcuate end surface 96 and the gage surface 98 maintain substantial conformance with the grinding surface 20 of the end wall 62, the lower side wall portion 64 and a substantial curved portion of the diffusing contour 68, as the cone wheel 16 rotates in confrontation or contact with the rotating container grinding surface 20. The conformance of the grinding surfaces 18 with the grinding face 20 results in increased grinding efficiency during operation. The feed particles are distributed approximately over the whole grinding face 20 and rotationally in advance of each of the cone wheel members 16 in a position for immediate contact by the cone wheel grinding surfaces 18. The introduced feed particles cannot avoid contact with the cone wheel grinding surfaces because no movement path exists to avoid contact except upward, but the weight of the feed particles holds them on the grinding face until crushed to a sufficiently small size to be carried away from the grinding face by the fluid flow. The raised diffusing contour 68 coupled with the contact of the gage surface 98 with the side wall portion 64 defines a generally upward concave grinding face which channels and holds the feed particles therein. The feed particles are channeled and forced into a crushing relationship without opportunity to be unduly moved about or to avoid immediate contact with the cone wheel members. The journal angle 90 creates an out thrust on the cone wheels as they rotate, thereby assuring that the gage surfaces 98 maintain a confronting relationship with the container side wall portion 64 even as wear of the grinding surfaces and face occurs and as the bearings 82 wear. The grinding effectiveness remains high due to the compensating effect inherent in the journal angle and cone wheel configuration. Thus, the particular configuration of the grinding surfaces 18 as they rotationally confront the conforming grinding face 20, and the particular configuration of the grinding apparatus 10, provides increased efficiencies over most prior art grinding devices.

Figure 6:
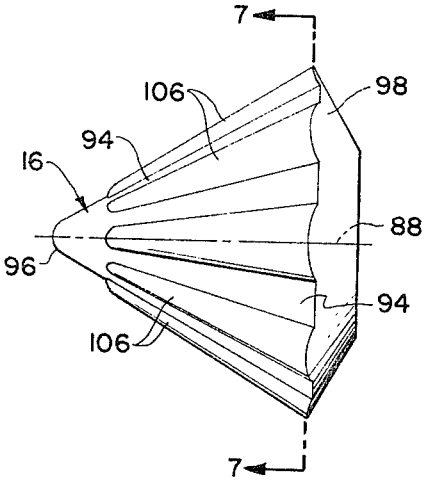
FIG. 6 is a side elevational view of one form of a cone wheel roller member.
Figure 7:
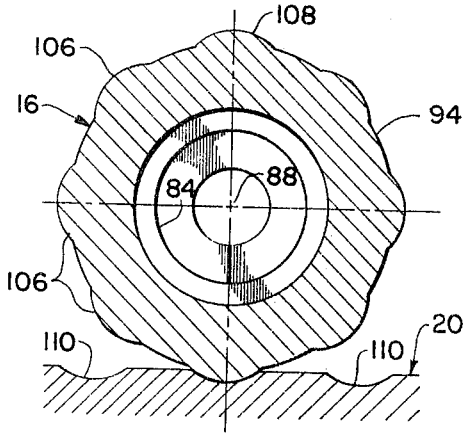
FIG. 7 is a section view taken substantially along line 7—7 of FIG. 6.

A modification of the grinding surfaces 18 of the cone wheels 16 increases the stress concentration on the feed particles to more readily crush them. As illustrated in FIGS. 6 and 7, the outer conically shaped surface portion 94 includes a plurality of tapered ridges 106 extending generally parallel to the axis 88 of rotation. The cross sectional configuration of each ridge presents a convex surface 108 extending outward from the conical surface 94. The convex surface 108 is more radically curved than the curve of the conical surface 94. The height and width of ridges 106 taper or converge inwardly toward the axis 88 along their lengths from the gage surface 98 to the inner end surface 96. At the inner end, the ridges converge into the arcuate end surface 96. Corresponding indentations 110 are formed in the grinding face 20 of the end wall 62, or the indentions may be worn into the end wall during use. The indentations 110 receive the ridges 106 as each cone wheel rotates over the grinding face 20. The ridges can be arranged to track the indentations, or the indentations may not be present in the grinding face, either due to intentional design or because the ridges randomly contact the grinding face during use. The arrangement and use of ridges and indentations is dictated by the type of material to be crushed and the desired fineness of the crushed particles.

The effect of the ridges is to apply crushing force on a more limited surface area of the particle than the conical surface 94 can apply. The application of the force on the more limited area concentrates the load application and more readily breaks or crushes the feed particles.

The type of materials employed on the grinding surfaces 18 of the cone wheels and on the grinding face of the container may be varied according to the type of application and use. A shell of very hard tungsten carbide, for example, can be bonded to the cone wheel grinding surfaces 18 and the grinding face 20 of the container 14 when crushing very abrasive materials. In certain food, drug and paint pigment grinding applications, the contamination from metallic machine elements is objectionable. A non-metallic shell such as aluminum oxide or a ceramic material, for example, can be bonded to the grinding surfaces of the cone wheels and grinding face of the container to avoid metallic contamination from metallic grinding elements.

The grinder apparatus 10 is connected to the stem member 22 by a threaded end connection 112 of the support body 78, shown in FIG. 2. A center opening 114 extends through the support body 78 and communicates with the conduit 24 of the stem member and the nozzle 30. The opening 114 is typically present in rotary rock bits. The nozzle 30 is formed by a tube member 116 which is suitably retained within the center opening 114. The tube member 116 converges inwardly to a nozzle orifice 118. The nozzle orifice 118 is closely axially adjacent the diffusing contour 68 so that the exiting feed particles and fluid are readily distributed over the grinding face 20 without loss of force effectiveness of the flow of fluid and feed particles.

The baffle cone 38 is positioned from the stem member 22, and the baffle tube 40 is connected by conventional means (not shown) to the baffle cone 38. A lip 120 of the baffle tube 40 extends in annular confronting relation with an annular upper edge 122 of the container 14. Seals 124 are positioned intermediate the lip 120 and the upper edge 122 to seal the annulus area 34 and the passageway 36. The seals 124 allow relative rotation of the container upper edge 122 with respect to the stationarily positioned lip 120. Conventional connection means (not shown) allows slight axial movement of the baffle cone 38 along the stem. Slight axial movement of the baffle members is necessary since slight relative axial movement of the container and grinder apparatus is required to maintain the closely confronting or contacting relationship of the grinding surfaces 18 and the grinding face 20 after periods of use and wear. It is apparent that a closed hydraulic communication system extends from the stem conduit 24, into the hollow interior 12, through the separation chamber 44 and out of the outlet 50.

Controlling the fluid flow velocity is a significant aspect of the present invention in at least two important respects. The fluid velocity over the grinding face controls the extent of grinding of the feed particles and also controls the size of the crushed particles obtained. The flow of fluid immediately removes the crushed particles from the grinding face once the size has been reduced within a predetermined desired range. Needless overgrinding of the crushed particles is avoided and the introduced feed particles immediately replace the removed crushed particles. Consequently, the feed particles are quickly and effectively crushed without unnecessarily moving either the crushed or the feed particles about. An estimated ninety percent (90%) of the input energy is expended in actual crushing or grinding activities, as contrasted with a significant lesser amount in prior art devices. The second important aspect of controlling the fluid flow is that fluid velocity effects can effectively classify or separate crushed particles by size. Major classification occurs at the grinding face where the introduced fluid removes only the crushed particles within the predetermined range of sizes while the larger particles are left for further crushing. It should be noted that the removed smaller crushed particles fall within a range of sizes less than and including a maximum desired size. All particles of weight (size) less than the maximum weight desired are easily carried by the fluid flow having a velocity and density sufficient to remove the maximum desired weight of particles. Further classification occurs by control of the fluid velocity after the fluid has flowed away from the grinding face 20. Within the separation chamber 44, the removed particles are separated into two or more different sizes. Thus, particle classification can be achieved as a part of the crushing operation with the attendant advantages of increased efficiency, reduction in cost, elimination of system complexity and reduction in the amount of machinery necessary to both crush and classify the particles, to name a few. Other advantages are apparent to those skilled in the art.

Velocity control in the present invention follows the principle that the quantity of fluid conducted in a unit of time is equal to the cross sectional area of the conducting passageway multiplied by the fluid velocity. The fluid velocity can thus be increased or decreased by respectively increasing or decreasing the quantity of fluid supplied from the fluid supply 28, while maintaining the cross sectional area of the flow conducting passageway is the same. Alternatively, the fluid velocity can be increased or decreased by respectively decreasing or increasing the cross sectional area of the conducting passageways while maintaining the quantity supply rate constant. It is the first type of velocity control, i.e. varying the quantity supply rate through a constant cross sectional passageway, which basically controls the extent of particle crushing at the grinding face. It is the second type of velocity control, i.e. varying the cross sectional area while maintaining a constant quantity supply rate, which classifies the crushed particles into a plurality of groups. Varying the cross sectional area of a passageway in a constant quantity flow situation has the effect of creating beneficial localized velocity control effects which are necessary for particle classification in the separation chamber, but both types of velocity control effects are interrelated in the present invention.

To determine the maximum size of the crushed particles removed from the grinding face 20, the quantity flow from the fluid supply 28 is controlled. The open areas of the grinding face 20 between the cone wheels 16 present a substantially constant cross sectional area for the fluid to flow away from the grinding face. Controlling the quantity flow from the supply 28 thus controls the fluid velocity over the grinding face, and the fluid velocity over the grinding face controls the size of crushed particles picked up and carried within that fluid flow. The cross sectional area of the annulus area 34 is slightly less than the cross sectional area of the open areas between cone wheels at the grinding face, to slightly increase the fluid velocity in the annulus area 34 and insure that the removed crushed particles do not settle back to the grinding face. The reduced cross sectional area circumjacent the support body 78 and stem 22 in the annulus area 34 is inherent in the preferred three cone wheel grinding apparatus 10. Reference to FIG. 4 shows in a very general way that the spaces 92 are smaller than those spaces in and around the cone wheels adjacent the grinding face 20.

The upward and outwardly extending annular passageway 36 is preferably arranged to present substantially constant cross sectional area approximately equal to the cross sectional area of the annulus 34. In this manner the crushed particles are forced to flow upward from the grinding face through the annular passageway 36 at approximately the same velocity. Since the circumference of the annular passageway increases with height, the radial width of the passageway must be reduced to maintain the same cross sectional area. The radial width is reduced by angling the confronting walls of the baffle cone member 38 and baffle tube member 40 toward one another. Alternatively the confronting walls of the baffle members 38 and 40 can converge toward one another sufficiently to slightly increase the fluid velocity if desired, thereby assuring continued upward particle movement through the annular passageway 36. The particles are conducted through the annular passageway 36 at a constant or slightly increasing rate, and the particles exit through the annular opening 42 into the separation chamber 44.

The area of the separation chamber at the opening 42 is considerably larger in cross section than the area of the opening 42, thus creating a substantial reduction in flow velocity as the fluid and crushed particles enter the chamber 44. The reduced flow velocity is sufficient to support and transport only those particles of a smaller range of sizes, and the larger particles settle or fall by gravity into the area 52. The smaller particles are carried and transported upward through the chamber 44 by the reduced flow rate and exit the separation chamber at the outlet 50. The cross sectional area between the opening 42 and the outlet 50 remains essentially constant.

Figure 8:
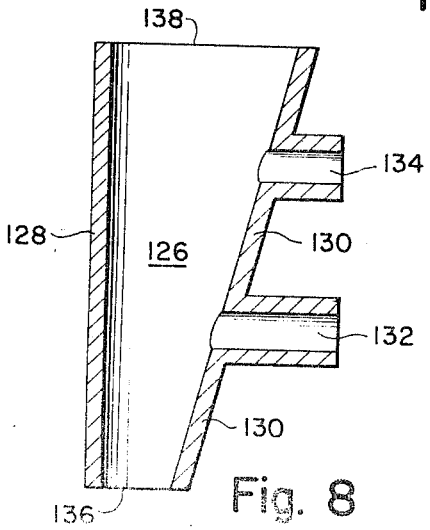
FIG. 8 is a generalized vertical section view of particle classification means illustrating fluid flow control and particle classification concepts involved in the present invention.

The separation chamber 44 can be arranged to control the fluid velocity therethrough in a manner for classifying and obtaining a variety of different sizes or groupings of crushed particles. As schematically illustrated in FIG. 8, a vertically extending passageway 126 is defined between wall members 128 and 130. Wall member 130 includes a plurality of vertically spaced outlets 132 and 134. The wall members 128 and 130 diverge outwardly and upwardly. Consequently, the cross sectional area of the passageway 126 progressively increases with height from the bottom 136 to the top 138. A fluid of constant flow velocity enters the bottom 136 of the passageway 126. The flow velocity progressively decreases with increasing height in the passageway. Particles of various sizes carried by the fluid flow congregate or hover at heights or levels where the upper drag force created by the upward flowing fluid counteracts the downward gravity force. The larger particles hover at lower heights in the passageway 126 where the fluid velocity is greater, while the smaller particles hover at greater heights where the flow velocity is reduced. These hovering particles are drawn off at the plurality of vertically spaced outlets 132 and 134. Particles drawn off from the lower outlet 132 are larger in size than those particles drawn off at the upper outlet 134.

FIG. 8 is intended only to schematically illustrate the flow reduction in particle classification concept involved in the present invention. In actuality and in accordance with comprehension of the invention, the quantity flow above each outlet 132 and 134 is reduced by the amount of fluid flowing out of the outlets, thereby creating a further reduction in quantity and fluid flow. If desired, compensation for the reduction in quantity flow is achieved by modifying the cross sectional area of the passageway 136 above each outlet 132 and 134.

An arrangement such as that illustrated by FIG. 8 can be achieved by providing an appropriate operative arrangement of baffle members similar to those baffle members 38 and 40. The arrangement of baffle members would be substituted for the separation chamber 44. The fluid and crushed particles flowing away from the grinding face 20 would be directly conducted into the bottom end, e.g. 136, of the passageway, e.g. 126, defined by the arrangement of baffle members.

It is also noted that a plurality of serially connected separation chambers could effect the same result as the FIG. 8 arrangement. One separation chamber would be employed to obtain each selected size range of crushed particles. The largest range of crushed particles would settle to the lower area 52 of the first separation chamber in the serial flow path, and the remainder of the crushed particles would be conducted through the outlet 50 to the next serially connected or second separation chamber. In the second separation chamber, the larger crushed particles are removed from the fluid flow therein in the same manner, and the remainder of the particles are conducted to the next separation chamber. The arrangement and operation continues through all of the serially connected separation chambers. The serial arrangement provides classified groups of crushed particles of progressively decreasing sizes from the beginning or first separation chamber to the last or ending separation chamber. The serially connected arrangement of separation chambers has the advantage of maintaining exactly the same quantity flow therethrough. Since the bottom removal outlet 58 of each chamber is sealed by the valve 56 when in use, none of the entering fluid escapes between the beginning and ending separation chambers. Consequently, the fluid velocities can be conveniently controlled by variations in the cross sectional area of the various fluid passages provided.

In the fluid control and circulation system described, a force or pressure is applied by the fluid supply 28 to create the desired flow velocity and quantity rates. The amount of fluid force or pressure applied depends on the density of the fluid, the desired flow velocity at the grinding face and the height or head to which fluid must be raised from the grinding face through each separation chamber or other particle classification means. Preferably, the conventional fluid supply 78 is directly regulated to supply desired fluid pressure and quantity flow rates. However, control can also be effected by various conventional regulation means in the fluid flow path downstream from the hollow interior of the grinding container. The fluid supplied can either be liquid or gas, depending upon the application and material to be crushed.

The material supply 26 is conventional and is arranged to supply approximately a constant flow or mass of friable feed particles. The material supply 26 can be separate from the fluid supply 28, as illustrated in FIG. 1, or can be integrated with the fluid supply. If separately supplied, the fluid and feed particles can be mixed in a single conduit 24 as shown in FIG. 1. If separately supplied, suitable particle delivery tubes (not shown) can be located in the areas 92 in positions rotationally in advance of the cone wheels for the purpose of delivering feed particles immediately in advance of each rotating cone wheel. Similarly, fluid delivery tubes (also not shown) can be located in the areas 92 in positions rotationally following the cone wheels for the purpose of directing the fluid on the grinding face and on particles immediately after they were crushed, thereby facilitating immediate removal of the small crushed particles from the grinding face. Other baffle and flow control apparatus (also not shown) can be employed in the areas 92 to aid in controlling the flow velocity of fluid generally at the grinding face 20. Such control arrangements depend upon the application, but these arrangements utilize the flow control principles embodied in the present invention.

The fluid supplied to the hollow interior of the container also achieves the beneficial effect of cooling the grinder apparatus and container during use. Considerable heat may be generated during a crushing operation, and this heat is readily removed by the fluid as it surrounds the grinder apparatus and flows from the hollow interior.

The preferred embodiment positions the grinding apparatus 10 stationarily while the container 14 is rotated. Connections of the fluid, particle supply and particle classification means are greatly simplified because the connections need not provide for relative rotation. However, the grinder apparatus can be rotated relative to a stationary container by rotating the stem member and holding the container stationary. Conventional swivel connections rotationally connect the fluid, feed particle and particle classification means to the rotating grinder apparatus 10. Apparatus for rotating the stem member can be conventional apparatus adapted from the drilling industry.

The method and operation of the present invention can be readily summarized by reference to FIGS. 1 and 2. The rotational apparatus 32 rotates the container 14 with respect to the stationarily positioned grinder apparatus 10. The grinding surfaces 18 of the cone wheel members 16 maintain a matching and confronting or contacting relation with the grinding face 20 of the container as the cone wheels roll over the rotating grinding face. Feed particles of friable material are supplied into the conduit 24 of the stem member 22 from the material supply 26 and the fluid supply 28. The mixture of fluid and feed particles is introduced by the nozzle 30 into the hollow interior of the container at a position above and adjacent to the diffusing contour 68. The introduced feed particles are contacted and crushed by the rotating cone wheel members while sufficient axial thrust is applied between the grinder apparatus and container to maintain the confronting relation of the grinding surfaces 18 with the grinding face 20. The feed particles are crushed at the grinding face and within the flow of fluid diffused over the grinding face. The particles which have been crushed to a sufficiently reduced size are picked up and transported by the fluid flowing over the grinding face. The fluid velocity from the fluid supply 28 is regulated to determine the extent of grinding and size of particles which are removed from the grinding face. The crushed particles and fluid flow up the annulus area 34 and into the annular passageway 36. The fluid and crushed particles carried by the fluid enter the settling chamber 44 at the opening 42. The flow rate within the settling chamber immediately decreases due to an increase in the cross sectional area of the flow passageway, and the reduced flow rate causes the larger particles to settle to the lower area 52 of the settling chamber. Particles sufficiently small to be transported by the reduced velocity flow of the fluid flowing through the separation chamber continue upwardly to the outlet 50. The fluid and crushed particles removed from the outlet 50 are conducted to the settling tank 54 or other particle classification means wherein the crushed particles can be readily removed from the fluid flow. The material collected at the lower area 52 of the settling chamber is periodically removed through the valves 56. Operation in this manner can be continued on a continuous basis if desired.

The significant advantages of the grinder apparatus and container arrangement have previously been described in detail, as have been the advantages of the fluid velocity control effects employed throughout the invention. Another significant advantage is that a significant amount of the technology and the special high production machine tools necessary to manufacture the grinder apparatus 10 are already in existence. This technology has previously been developed by the drilling industry, and many of the solutions to problems in the drilling industry are equally applicable to the present grinding apparatus. Consequently, the grinder apparatus can be manufactured very economically in relatively large numbers.

The preferred embodiments of the present invention have been described with a degree of particularity. It should be understood, however, that the degree of specificity is not intended to restrict the spirit and scope of the invention or the definition thereof in the appended claims.

I claim as my invention:

1. Apparatus for crushing friable material into particulate form, comprising:

a container having a closed and upward-opening hollow interior and defining a grinding face facing upward into the hollow interior;

grinder apparatus adapted to be positioned in the hollow interior of said container and comprising a support body and a plurality of roller members operatively and rotationally connected to the support body for confronting the grinding face of said container;

means for positioning said grinder apparatus in the hollow interior of said container with the plurality of roller member substantially confronting the grinding face of said container;

means operatively connected for effecting relative rotation of said container and said grinder apparatus;

means for introducing into the hollow interior of said continer a supply of friable material to be crushed into particles;

means for continuously supplying fluid at a predetermined flow rate to the hollow interior of said container and for directing the supplied fluid over the grinding face;

means defining at least one outlet communicating with the hollow interior for conducting particles of material within a flow of fluid exiting the hollow interior of said container, each outlet being positioned at a predetermined position spaced above the grinding face whereby the particles conducted in the flow of fluid out of said closed hollow interior must move upwardly away from the grinding face in order to exit the hollow interior of said container; and the predetermined flow rate of supplied fluid being sufficient to transport particulate matter of a predetermined range of weights upward and away from the grinding face to each said outlet and being insufficient to remove particulate matter of weights greater than the predetermined range from the grinding face.

2. Apparatus for crushing friable material into particulate form, comprising:

a container having a side wall and an end wall, the end wall extending inwardly from the side wall to thereby define a hollow interior of said container;

grinder apparatus comprising a support body, a plurality of generally frustoconically-shaped roller members, and means for rotationally connecting each roller member to the support body;

means for positioning said grinder apparatus within the hollow interior of said container with each of the roller members in substantially confronting relation with the end wall;

means operatively interconnected for effecting relative rotation of said container and said grinder apparatus;

means for operatively applying a thrust force between said grinder apparatus and said container to force said roller members into crushing confronting relation with the container end wall during crushing of friable material;

each of said roller members having an outer grinding surface of predetermined contour for maintaining substantial crushing conformance with the end wall and a portion of the side wall adjoining the end wall as said roller members rotate; and means operative from the axial thrust force between said grinder apparatus and said container for continually forcing all of said roller members outward to create and maintain a crushing conforming relationship between the portion of the sidewall and the conforming portions of the grinding surfaces of the roller members during crushing of the friable material therebetween.

3. Apparatus as recited in claim 2 further comprising:

means for introducing into the hollow interior of said container a supply of friable material to be crushed into particles; and means for continuously supplying fluid at a predetermined flow rate to the hollow interior of said container and for directing the supplied fluid over the end wall in the interior of said container, the predetermined flow rate being sufficient for transporting particulate matter of a predetermined range of weights substantially away from the end wall in the hollow interior of said container and insufficient to remove particles of weights greater than the predetermined range from the end wall within the hollow interior.

4. Apparatus as recited in claim 3 wherein said container defines a closed and upward facing hollow interior; and further comprising means defining at least one outlet communicating with the hollow interior at a predetermined position spaced upwardly from the end wall, said outlet defining means conducting particles of materials within a flow of fluid exiting the hollow interior of said container.

5. Grinder apparatus for crushing friable material into particulate form, comprising:

a relatively rotationally mounted container having a side wall and end wall defining a hollow interior, the side wall including a continuous lower circular portion and the end wall extending inwardly from the side wall circular portion to the axis of relative rotation, said circular side wall portion and a portion of said end wall defining a grinding surface upon which the friable material is crushed;

a plurality of generally frustoconically-shaped cone wheel roller members, each cone wheel member having an outer generally conically shaped grinding surface, each cone wheel member adapted to rotate about an axis substantially coaxial with the axis of the conically shaped surface, each roller member further having a gage grinding surface extending inwardly toward the cone wheel rotational axis from the conically shaped surface at the point of maximum diameter of the conically shaped surface;

a support body having a center axis, said support body adapted to be positioned with the body center axis substantially coaxial with the axis of relative rotation;

a plurality of legs rigidly depending from the support body at substantially equal radial distances and circumferential intervals with respect to the support body center axis, each leg having an outer surface positioned radially outward from the body center axis a distance less than the radius of the side wall portion of said container, the outer surface of each leg adapted for positioning in next adjacent and noncontacting relation with the side wall of the container above the lower circular portion of the side wall, the plurality of legs being equal in number to the plurality of cone wheel members, each leg including a journal member rigidly attached to each said leg and bearing means for rotationally mounting one cone wheel member on the journal member with the cone wheel rotational axis extending at a journal angle defined by the acute extension of the cone wheel rotational axis with respect to the center axis, each cone wheel roller member being positioned on each journal member with the point of minimum diameter of the conically shaped surface confronting the end wall at a point adjacent the axis of relative rotation of the container and the point of maximum diameter of the conically shaped surface confronting the end wall at the lower circular portion of the side wall;

means operatively interconnecting said support body and said container for operatively positioning the grinding surfaces of each of said roller members in confronting relation with the grinding surface of said container;

means for rotating said container relative to said support body;

means for applying axial thrust force between the outer conically-shaped grinding surfaces of said roller members and said container during crushing of friable material, the axial thrust force being transmitted from the support body through said legs and said journal members and said bearing means to each said roller member;

the outer conical surface and gage surface and the journal angle being of predetermined interrelationship to maintain substantial grinding conformance of the conically shaped and gage grinding surfaces with a major portion of the end wall and the circular portion of the side wall of said container respectively, upon relative rotation of said cone wheel members in crushing confrontation with the grinding surface of said container; and the journal angle being predetermined to create a continuous out-thrust force toward the side wall on said roller members from the axial thrust force transferred to said journal member during rotation of said roller members, the out-thrust force being of sufficient magnitude to continually force the gage grinding surface toward the circular side wall portion of said container and maintain the crushing confronting relationship therebetween during crushing of friable material.

6. Apparatus as recited in claim 5 further comprising:

means for introducing into the hollow interior of said container a supply of friable material to be crushed into particles; and means for continuously supplying fluid at a predetermined flow rate to the hollow interior of said container, the predetermined flow rate being sufficient for transporting particulate matter of a predetermined range of weights substantially away from the end wall and through the hollow interior of said container and insufficient to remove particles of weights greater than the predetermined range of weights from the end wall.

7. Apparatus as recited in claim 6:

wherein said container defines a closed and upward facing hollow interior; and further comprising means defining at least one outlet communicating with the hollow interior at a predetermined position spaced from the end wall, said outlet defining means conducting particles of materials within a flow of fluid exiting the hollow interior of said container.

8. Apparatus as recited in claims 1, 4 or 7 further comprising:

a separation chamber operatively connected in fluid communicating relationship with said outlet defining means of said container.

9. Apparatus as recited in claim 8 wherein said separation chamber includes second outlet defining means positioned substantially below the outlet defining means first aforementioned and a third outlet defining means positioned above the first outlet defining means, and said second outlet defining means being adapted to remove particles of generally larger weight from the separation chamber than the particles removed from said separation chamber by said third outlet defining means.

10. Apparatus as recited in claim 9 wherein said separation chamber further comprises:

flow velocity controlling means for reducing the flow velocity of fluid in the separation chamber in the vicinity of said third outlet defining means as compared to the flow velocity of fluid entering the separation chamber at said first outlet defining means.

11. Apparatus as recited in claims 1, 3 or 7 further comprising:

means defining a generally upward extending passageway operatively connected at a lower end thereof to said outlet defining means, said passageway being of predetermined cross section for reducing the flow velocity from the lower end to the upper end; and means defining at least one secondary outlet intermediate the upper and lower ends of said passageway.

12. Apparatus as recited in claims 1, 3 or 6, wherein the friable material and fluid are both supplied to the hollow interior at a position approximately adjoining a surface of the hollow interior where grinding takes place.

13. Apparatus as recited in claim 1 wherein:

said grinder apparatus includes a center opening defined by the support body;

said positioning means comprises a stem member connected to the support body of said grinder apparatus, the stem member defining a conduit communicating with the center opening of the support body; and at least one of said friable material introducing means and said fluid supply means comprises the conduit and center opening.

14. Apparatus as defined in claim 3 wherein:

said grinder apparatus includes a center opening defined by the support body;

said positioning means comprises a stem member connected to the support body of said grinder apparatus, the stem member defining a conduit communicating with the center opening of the support body; and at least one of said friable material introducing means and said fluid supplying means comprises the conduit and center opening.

15. Apparatus as recited in claim 6:

wherein said grinder apparatus includes a center opening defined by the support body; and further comprising positioning means operatively connected for positioning said grinder apparatus in the hollow interior of said container, said positioning means comprising a stem member connected to the support body of said grinder apparatus, the stem member defining a conduit communicating with the center opening of the support body; and wherein at least one of said friable material introducing means and said fluid supplying means comprises the conduit and center opening.

16. Apparatus as recited in claims 13, 14 or 15 wherein the center opening is defined in the support body at a position substantially at the relative rotational axis of said grinder apparatus and said container.

17. Apparatus as recited in claim 16 further comprising:

means connected to said container within the hollow interior for diffusing the matter supplied from the center opening substantially outward from the outer opening over a surface of the hollow interior where grinding takes place.

18. Apparatus as recited in claims 1 or 4:

wherein said positioning means comprises a stem member connected to the support body of said grinder apparatus and extending out of the hollow interior of said container; and further comprising baffle means supported by the stem member and extending out of the hollow interior of said container, said baffle means conducting the flow of fluid and particulate material out of the hollow interior and controlling the flow velocity of fluid conducted between the hollow interior of said outlet defining means.

19. Apparatus as recited in claim 7 further comprising:

means for positioning said grinder apparatus in the hollow interior of said container, said positioning means comprising a stem member connected to the support body of said grinder apparatus and extending out of the hollow interior of said container; and baffle means supported by the stem member and extending out of the hollow interior of said container, said baffle means conducting the flow of fluid and particles out of the hollow interior and controlling the flow velocity of fluid between the hollow interior and said outlet defining means.

20. Apparatus as recited in claim 1 wherein:

said container includes a side wall and an end wall, the end wall extending inwardly from the side wall to thereby define the grinding face of said container; and each of said roller members has an outer grinding surface of predetermined contour for maintaining substantial grinding conformance with the end wall and a portion of the side wall adjoining the end wall as said roller members rotate.

21. Apparatus as recited in claims 2 or 20 wherein the predetermined contour of the grinding surface of each roller member includes a generally conically shaped portion.

22. Apparatus as recited in claim 21 wherein:

the lower portion of the side wall adjacent the end wall is substantially concentric about the axis of relative rotation of the container and the grinder apparatus, and the grinding surface of each roller member further includes a gage surface extending from the conically shaped surface inward toward the axis of roller member rotation, said gage surface adapted to maintain matching grinding relation with the lower portion of the container side wall adjoining the container end wall.

23. Apparatus as recited in claim 22 wherein:

said support body has a center axis positioned substantially coaxially with the relative rotational axis of said container and said grinder apparatus, said support body including a plurality of legs depending therefrom at substantially equal radial distances and circumferential intervals with respect to the body center axis, each leg having an outer surface positioned from the body center axis at a distance less than the radius of the concentric side wall of said container and in next adjacent relation with the side wall of said container, the plurality of legs being equal in number to the plurality of roller members, each leg including means for rotationally mounting one roller member to said leg.

24. Apparatus as recited in claim 23 wherein the rotational axis of each roller member is offset with respect to a radial reference from the relative rotational axis of said container and said grinder apparatus.

25. Apparatus as recited in claim 23 wherein three roller members are operatively connected to said grinder apparatus.

26. Apparatus as recited in claim 22 wherein at least one of the grinding surface of each roller member and the grinding face of said container are formed of nonmetallic material.

27. Apparatus as recited in claim 26 wherein the non-metallic material is ceramic material.

28. Apparatus as recited in claim 21 wherein:

each conically shaped surface includes a plurality of ridges formed therein extending generally parallel to the rotational axis of said roller member.

29. Apparatus as recited in claim 5 wherein three cone wheel members are provided.

30. Apparatus as recited in claim 5 wherein the grinding surface of at least one cone wheel member and the end wall of the hollow interior of said container are formed of non-metallic material.

31. Apparatus as recited in claim 30 wherein the non-metallic material is ceramic material.

32. Apparatus as recited in claim 5 wherein:

each conically shaped surface includes a plurality of ridges formed therein extending generally parallel with the rotational axis of said cone wheel member.

33. Apparatus as recited in claim 5 wherein the rotational axis of each cone wheel member is offset with respect to a radial reference from the relative rotational center of said container and said grinder apparatus.

34. A method of crushing friable material into particles and classifying the particles of crushed material, comprising:

providing a container having a closed, upward-opening, fluid-tight hollow interior and a grinding face within the interior, introducing feed particles of friable material into the interior of the container.

continuously supplying fluid at a predetermined quantity flow and flow velocity into the interior at a position near the grinding face of the container, crushing the feed particles into crushed particles at the grinding face of the container, the crushed particles being within and without of a predetermined range of weights, mixing all of the crushed particles within the fluid supplied near the grinding face, providing a passageway extending upward away from the grinding face which is separate from the fluid supplied and feed particles introduced, the passageway defining the only outlet from the hollow interior of said container, the quantity flow and flow velocity of the supplied fluid at positions near the grinding face being predetermined (a) to create sufficient drag force on the crushed particles within the predetermined range to overcome gravity and transport the crushed particles within the predetermined range upward away from the grinding face and into the passageway and (b) to create insufficient drag force on the particles without the predetermined range to overcome gravity whereby the particles without the predetermined range fall back to the grinding face for further crushing, directing the fluid and crushed particles within the predetermined range carried by the fluid through the passageway, and removing crushed particles within the predetermined range from the passageway.

35. A method as recited in claim 34 further comprising:

controlling the fluid velocity through the passageway.

36. A method of crushing friable material into crushed particles within a predetermined range of sizes, comprising:

crushing friable material into crushed particles of random sizes on a grinding face by guiding rollers within a hollow fluid-tight and upward-opening interior of a container, the random sizes including particles within and without of the predetermined range;

continuously supplying fluid of a predetermined quantity flow and flow velocity into the interior of the container;

directing the supplied flow of fluid substantially over the whole grinding face and over the crushed particles on the grinding face;

controlling the velocity of fluid flow directed over the grinding face to create sufficient force on the crushed particles of sizes within the predetermined range to remove only the particles within the predetermined size range away from the grinding face and upward out of the hollow interior of the container through a passageway separate from the incoming supplied flow of fluid while particles without of the predetermined size range remain at the grinding face; and removing fluid and particles from the hollow interior of the container only at a position upwardly spaced above the grinding face.

37. A method as recited in claim 36 further comprising:

providing a passageway extending away from the grinding face, directing fluid and crushed particles carried by the fluid from the grinding face into the passageway;

controlling the velocity of fluid within the passageway; and removing crushed particles from the passageway.

38. A method of crushing friable material into particles, comprising:

providing a container having an end wall and a side wall the side wall connecting to the end wall to define a hollow interior of the container, the side wall having a lower portion adjoining the end wall, the end wall and the lower portion of the side wall defining a grinding face of the container;

positioning a plurality of rotationally connected roller members within the interior of the container, each roller member positioned to rotate about an axis, each roller member having an outer grinding surface of predetermined contour to essentially maintain a matching and confronting relationship with the grinding face of the container as each roller member rotates about its axis;

confronting the grinding surfaces of the roller members with the grinding face of the container;

rotating the container relative to the axes of rotation of the roller members;

introducing feed particles of friable material to be crushed into the interior of said container;

applying axial thrust force between the end wall of the container and the portion of the grinding surfaces of each roller member confronting the end wall of the container; and developing a continual out-thrust force on each said roller member from the axial thrust force, the out-thrust force being applied to each roller member in a direction toward the side wall of said container, the out-thrust force being sufficient to force the roller members outwardly and establish a continual crushing relationship between the lower portion of the side wall and the confronting portion of the grinding surfaces of each roller member during crushing of friable material therebetween.

39. A method as recited in claim 38 further comprising:

continuously supplying fluid at a predetermined flow velocity into the interior at a position near the grinding face, and conducting fluid and crushed material carried by the fluid out of the hollow interior of the container.

40. A method as recited in claim 39 further comprising:

providing a passageway extending away from the grinding face, directing fluid and crushed particles carried by the fluid from the grinding face into the passageway, controlling the velocity of fluid within the passageway, and removing crushed particles from the passageway.

41. A method as recited in claims 35, 37 or 40 further comprising:

extending the passageway upwardly away from the grinding face;

progressively reducing the flow velocity from a lower position to an upper position in the passageway; and removing fluid and particles carried by the fluid at a plurality of predetermined positions within the passageway, at least two of the predetermined positions being vertically spaced with respect to one another within the vertical height position wherein the fluid velocity is progressively reduced.

42. A method as recited in claims 35, 37 or 40 further comprising:

conducting the fluid and crushed particles from the passageway into an inlet of a separation chamber, and decreasing the flow velocity in the separation chamber between the inlet and an outlet of the separation chamber.

43. A method as recited in claims 34 or 38 further comprising:

distributing the introduced feed particles over substantially the whole grinding face.

44. A method as recited in claim 43 further comprising:

continuously introducing feed particles at an approximately constant rate.

45. A method as recited in claim 36 further comprising:

introducing friable material in the form of feed particles, and distributing the feed particles over substantially the whole grinding face.

46. A method as recited in claims 34 or 35 further comprising:

distributing the fluid supplied over substantially the whole grinding face, and controlling the velocity of fluid distributed over the grinding face.

47. A method as recited in claims 34 or 36 wherein the step of crushing the friable material further comprises:

providing a plurality of rotationally connected roller wheels each having a grinding surface of predetermined contour to maintain substantial matching and confronting relation with the grinding face as each roller member rotates about its axis, and rolling the roller wheel members over the grinding face.

48. Apparatus as recited in claims 2 or 5 wherein the hollow interior of said container is closed and substantially fluid tight.

49. Apparatus as recited in claim 13 wherein the grinding face of said container further comprises:

means for diffusing the matter supplied from the center opening over substantially the whole grinding face.

50. Apparatus as recited in claims 14 or 15 wherein the end wall of said container further comprises:

means for diffusing the matter supplied from the center opening over substantially the whole end wall within the hollow interior.

51. A method as recited in claims 34 or 36:

wherein the step of crushing comprises rolling a roller member over the grinding face and directing the friable material between the roller member and the grinding face; and further comprising introducing friable material onto the grinding face immediately relatively rotationally in advance of the roller member; and further comprising directing the flow of fluid over the grinding face immediately relatively rotationally following the roller member to immediately remove the particles within the predetermined range away from the grinding fce.

52. Apparatus for crushing friable material into particulate matter, comprising:

a container comprising a continuous end wall and a side wall extending away from the end wall, the side and end walls defining a hollow interior of said container, a portion of the surface of the end wall within the hollow interior defining a grinding face;

a support body positioned above the hollow interior of the container;

a plurality of legs depending from the support body and extending toward the end wall of said container;

a plurality of generally frustoconically shaped cone roller members, each cone roller member having a generally conically shaped exterior grinding surface, each of said cone roller members being rotationally connected to a leg at an outer axial end of the cone roller member adjacent the maximum circumference of grinding surface, the cone roller members extending inward from the legs toward a center location at which the inner axial ends of the cone roller members of minimum grinding surface circumference are adjacent one another, said cone roller members further being operatively oriented to maintain the grinding surface in confronting grinding relation with the grinding face;

means for operatively forcing the grinding face in confronting grinding relation with the grinding surfaces of all of said cone roller members;

means for rotating said container relative to said support body to thereby roll the grinding surfaces of said cone roller members over the grinding face of said container;

means for introducing friable material into said hollow interior at a location adjacent the grinding face and relatively rotationally in advance of at least one cone wheel member;

means attached to said support body and defining nozzle orifice adjacently spaced from the grinding face at the center location at which the inner axial ends of the cone wheel members are adjacent one another; and means for conducting fluid through said nozzle orifice at a predetermined flow rate into the hollow interior.

53. Apparatus as recited in claim 52 wherein each said cone roller member is cantileverly connected to each leg only at the outer axial end of each cone roller member.

54. Apparatus as recited in claims 52 or 53 wherein said end wall includes a diffusing contour portion protruding from the grinding face into the center location at which the inner axial ends of the cone wheel members are adjacent one another, said diffusing contour portion distributing the fluid over substantially the whole grinding face between the cone wheel members.

55. Apparatus as recited in claim 54 wherein:

a portion of the side wall of said container adjoining and extending from end wall is concentric about an axis of said container about which relative rotation occurs; and each of said cone roller member also has a gage surface extending inward toward the cone roller rotational axis from the conically shaped exterior surface at the position of maximum circumference of the conically shaped exterior surface, the concentric portion of the side wall and the gage surfaces are of complimentary shape for maintaining a confronting grinding relationship during relative movement.

56. Apparatus as recited in claim 55 wherein the diffusing contour portion and the inner ends of the cone roller members are of complimentary shape to an extent above the grinding face, whereby the protruding diffusing contour portion and the concentric side wall portion define a concavity for channelling and confining the friable material until it is crushed into the predetermined range.

57. Apparatus as recited in claim 52 wherein the axis of rotation of each cone wheel member is offset.

58. Apparatus for crushing friable material into particulate form, comprising:

a container having a side wall and an end wall, the end wall extending inwardly from the side wall to thereby define a hollow interior of said container;

grinder apparatus comprising a support body, a plurality of generally frustoconically-shaped roller members, and means for rotationally connecting each roller member to the support body;

means for positioning said grinder apparatus within the hollow interior of said container with each of the roller members in substantially confronting relation with the end wall;

means operatively connected for effecting relative rotation of said container and said grinder apparatus;

each of said roller members having an outer grinding surface of predetermined contour for maintaining substantial crushing conformance with the end wall and a portion of the side wall adjoining the end wall as said roller members rotate;

means for introducing into the hollow interior of said container a supply of friable material to be crushed into particles; and means for continuously supplying fluid at a predetermined flow rate to the hollow interior of said container and for directing the supplied fluid over the end wall in the interior of said container, the predetermined flow rate being sufficient for transporting particulate matter of a predetermined range of weights substantially away from the end wall in the hollow interior of said container and insufficient to remove particles of weights greater than the predetermined range from the end wall with the hollow interior.

* * * * *